US007577566B2

(12) United States Patent
Morii

(10) Patent No.: US 7,577,566 B2
(45) Date of Patent: Aug. 18, 2009

(54) METHOD FOR ENCODING SOUND SOURCE OF PROBABILISTIC CODE BOOK

(75) Inventor: Toshiyuki Morii, Kawasaki (JP)

(73) Assignee: Panasonic Corporation, Osaka (JP)

( * ) Notice: Subject to any disclaimer, the term of this patent is extended or adjusted under 35 U.S.C. 154(b) by 316 days.

(21) Appl. No.: 10/531,417

(22) PCT Filed: Nov. 11, 2003

(86) PCT No.: PCT/JP03/14298

§ 371 (c)(1),
(2), (4) Date: Jun. 2, 2005

(87) PCT Pub. No.: WO2004/044893

PCT Pub. Date: May 27, 2004

(65) Prior Publication Data

US 2005/0228653 A1 Oct. 13, 2005

(30) Foreign Application Priority Data

Nov. 14, 2002 (JP) ..... 2002-330768

(51) Int. Cl.
*G10L 19/10* (2006.01)
*G10L 19/12* (2006.01)

(52) U.S. Cl. ..... 704/221; 704/212; 704/223

(58) Field of Classification Search ..... 704/203, 704/212, 221, 222, 223, 216, 220
See application file for complete search history.

(56) References Cited

U.S. PATENT DOCUMENTS 5,228,086 A * 7/1993 Morii ..... 704/207
5,396,576 A * 3/1995 Miki et al. ..... 704/222
5,751,901 A * 5/1998 DeJaco et al. ..... 704/216
5,774,838 A * 6/1998 Miseki et al. ..... 704/222
5,825,311 A 10/1998 Kataoka et al.
5,943,644 A * 8/1999 Yamane et al. ..... 704/207
6,330,534 B1 12/2001 Yasunaga et al.
6,330,535 B1 * 12/2001 Yasunaga et al. ..... 704/223
6,345,247 B1 * 2/2002 Yasunaga et al. ..... 704/219
6,421,639 B1 * 7/2002 Yasunaga et al. ..... 704/223

(Continued)

FOREIGN PATENT DOCUMENTS

JP 8-110799 4/1996

(Continued)

OTHER PUBLICATIONS

English Language Abstract of JP 8-110799.

(Continued)

*Primary Examiner*—Martin Lerner
(74) *Attorney, Agent, or Firm*—Greenblum & Bernstein P.L.C.

(57) ABSTRACT

A stochastic codebook associates a pulse position of a predetermined channel with a pulse position of another channel, searches for a pulse position by means of a predetermined algorithm, and outputs a code combining a found pulse position with a polarity code to an excitation vector creation section as a stochastic excitation vector code. By this means, it is possible to secure variations so that there are no positions where there is no pulse at all while achieving a reduction of the number of bits used when coding stochastic codebook pulses in order to attain a lower bit rate.

4 Claims, 5 Drawing Sheets

U.S. PATENT DOCUMENTS

| | | | | |
|---|---|---|---|---|
| 6,470,313 | B1 * | 10/2002 | Ojala | 704/223 |
| 6,910,008 | B1 * | 6/2005 | Yasunaga et al. | 704/223 |
| 7,392,179 | B2 * | 6/2008 | Yasunaga et al. | 704/222 |
| 7,398,206 | B2 * | 7/2008 | Morii et al. | 704/223 |
| 2001/0001320 | A1 * | 5/2001 | Heinen et al. | 704/222 |
| 2003/0225576 | A1 * | 12/2003 | Li et al. | 704/222 |
| 2006/0235682 | A1 * | 10/2006 | Yasunaga et al. | 704/223 |

FOREIGN PATENT DOCUMENTS

| | | |
|---|---|---|
| JP | 2000-322097 | 11/2000 |
| JP | 2001-184097 | 7/2001 |
| JP | 2002-169595 | 6/2002 |

OTHER PUBLICATIONS

English Language Abstract of JP 2000-322097.
English Language Abstract of JP 2001-184097.
English Language Abstract of JP 2002-169595.
An article by M. R. Schroeder et al., entitled "Code-Excited Linear Prediction (CELP): High-Quality Speech at Very Low Bit Rates," IEEE, pp. 937-940 (1985).

* cited by examiner

METHOD FOR ENCODING SOUND SOURCE OF PROBABILISTIC CODE BOOK

TECHNICAL FIELD

The present invention relates to a stochastic codebook excitation vector coding method in a CELP speech coding apparatus/speech decoding apparatus.

BACKGROUND ART

When speech signals are transmitted in a packet communication system typified by Internet communication, a mobile communication system, or the like, compression and coding techniques are used to improve the speech signal transmission efficiency. Many speech coding methods have been developed to date, and many low bit rate speech coding methods developed in recent years, such as CELP, separate a speech signal into spectrum envelope information and spectrum detailed structure information, and perform compression and coding of the separated information.

In a CELP speech coding apparatus, synthetic speech vectors are calculated for all combinations of adaptive code vectors stored by an adaptive codebook and fixed code vectors stored by a stochastic codebook, distance calculation is performed for each synthetic speech and input speech signal, and the adaptive code vector index and fixed code vector index for which the distance is smallest are found.

One known stochastic codebook is an algebraic codebook. This codebook enables a stochastic codebook search to be performed with a comparatively small amount of calculation, and has consequently been widely used in CELP in recent years.

An excitation vector of an algebraic codebook is composed of a small number of pulses with an amplitude of 1 and polarities (+, −), and the pulses (in this case, excitation vector waveform candidates) are positioned so as not to overlap each other.

For example, when the subframe length is 32 and the number of pulses (=number of channels) is 4, the number of pulses per channel is 32/4=8, and the channel 0 pulse positions ici0[i0], channel 1 pulse positions ici1[i1], channel 2 pulse positions ici2[i2], and channel 3 pulse positions ici3[i3] are as shown below. Here, i0, i1, i2, and i3 denote indexes of the respective channels.

ici0[i0]={0, 4, 8, 12, 16, 20, 24, 28}
ici1[i1]={1, 5, 9, 13, 17, 21, 25, 29}
ici2[i2]={2, 6, 10, 14, 18, 22, 26, 30}
ici3[i3]={3, 7, 11, 15, 19, 23, 27, 31}

A conventional stochastic codebook codes the pulse positions of each channel independently, and takes codes combining these with polarity codes as stochastic excitation vector codes.

For example, in the above case of a subframe length of 32 and 4 channels, a conventional codebook 103 represents a pulse position of each channel as 3 bits, and together with the polarity code, performs coding using a code of (3+1)×4=16 bits.

However, a problem with the above conventional stochastic codebook coding method is that, if the bit rate is low the bits assigned to each channel are also limited, and there are positions where there is no pulse at all, so that variations of an excitation vector waveform corresponding to a code (position information) decrease, and sound quality degradation occurs.

In the above case of a subframe length of 32 and 4 channels, for example, there are positions where there is no pulse at all if coding is performed with fewer than 16 bits.

DISCLOSURE OF INVENTION

It is an object of the present invention to provide a stochastic codebook excitation vector coding method that enables variations to be secured so that there are no positions where there is no pulse at all while achieving a reduction of the number of bits used when coding stochastic codebook pulses.

This object is achieved by associating a pulse position of a predetermined channel with a pulse position of another channel, searching for a pulse position by means of a predetermined algorithm, and taking a found pulse position code and a polarity code as a stochastic excitation vector code.

BEST MODE FOR CARRYING OUT THE INVENTION

Figure 1:
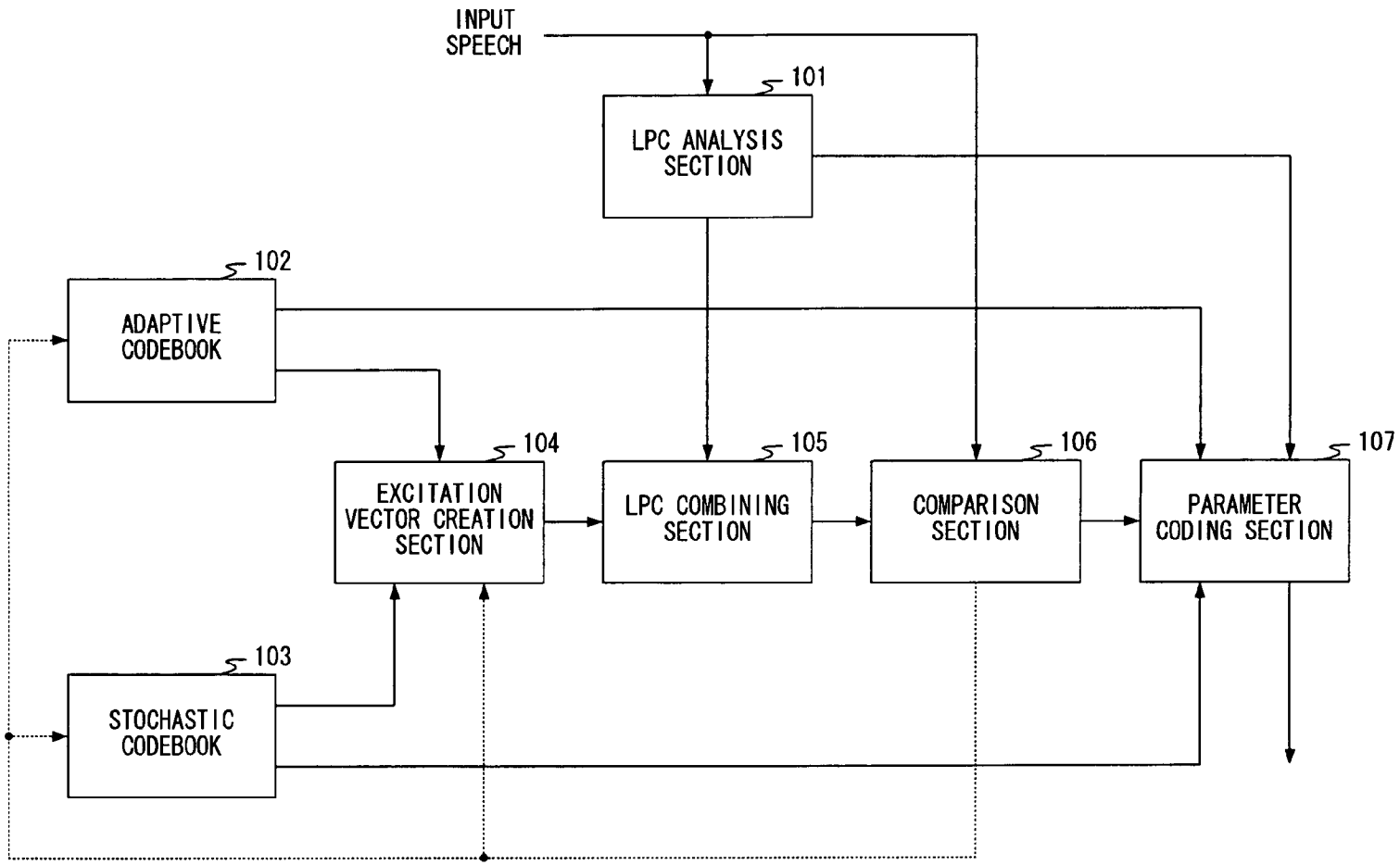
FIG. 1 is a block diagram showing the configuration of a CELP speech coding apparatus.

FIG. 1 is a block diagram showing the configuration of a CELP speech coding apparatus. An input speech signal is input sequentially to the speech coding apparatus divided into processing frames at time intervals of approximately 20 ms.

The input speech signal input to the speech coding apparatus every processing frame is first supplied to an LPC analysis section 101. LPC analysis section 101 performs LPC (Linear Predictive Coding) of the input speech signal and obtains an LPC coefficient, performs vector quantization of the LPC coefficient to produce an LPC code, and decodes this LPC code to obtain a decoded LPC coefficient.

An excitation vector creation section 104 reads an adaptive code vector and fixed code vector respectively from an adaptive codebook 102 and stochastic codebook 103, and sends these to an LPC combining section 105. LPC combining section 105 performs combining filtering of the adaptive code vector and fixed code vector supplied from excitation vector creation section 104, and the decoded LPC coefficient provided from LPC analysis section 101, with an all pole type combining filter in the filter coefficient, and obtains a combined adaptive code vector and combined fixed code vector.

A comparison section 106 analyzes the relationship between the combined adaptive code vector and combined fixed code vector output from LPC combining section 105, and finds adaptive codebook optimum gain to be multiplied by the combined adaptive code vector, and stochastic codebook optimum gain to be multiplied by the combined fixed code vector.

Comparison section 106 also adds together the vector obtained by multiplying the combined adaptive code vector by the adaptive codebook optimum gain and the vector obtained by multiplying the combined fixed code vector by the stochastic codebook optimum gain, and obtains a combined speech vector, and performs a distance calculation on the combined speech and input speech signal. Then comparison section 106 obtains the adaptive code vector stored by adaptive codebook 102 and the combined speech vector stored by stochastic codebook 103, and finds the adaptive code vector index and fixed code vector index for which the distance between the combined speech and input speech signal is smallest. Comparison section 106 then sends the indexes of the code vectors output from the codebooks, the code vectors corresponding to the respective indexes, and the adaptive codebook optimum gain and stochastic codebook optimum gain, to a parameter coding section 107.

Parameter coding section 107 codes the adaptive codebook optimum gain and stochastic codebook optimum gain and obtains a gain code, and outputs the gain code, the LPC coefficient provided by LPC analysis section 101, and the indexes of each codebook together for each processing frame.

Parameter coding section 107 also adds together the two vectors comprising the vector obtained by multiplying the adaptive code vector corresponding to the adaptive codebook index by the adaptive codebook gain corresponding to the gain code, and the vector obtained by multiplying the fixed code vector corresponding to the stochastic codebook index by the stochastic codebook gain corresponding to the gain code, and obtains a drive excitation vector, and updates the old adaptive code vector in adaptive codebook 102 with the drive excitation vector.

Combining filtering by LPC combining section 105 generally makes combined use of a linear predictive coefficient, a high emphasis filter, and a weighting filter that uses a long-term predictive coefficient obtained by long-term predictive analysis of input speech.

Adaptive codebook and stochastic codebook optimum index searches, optimum gain calculation, and optimum gain coding processing are generally carried out in subframe units resulting from further division of a frame.

In a speech decoding apparatus (decoder), the same configuration of LPC analysis section 101, adaptive codebook 102, stochastic codebook 103, excitation vector creation section 104, and LPC combining section 105 is provided as shown in FIG. 1, and an excitation vector waveform is obtained by decoding codes transmitted from a speech coding apparatus.

In order to reduce the amount of calculation, comparison section 106 usually searches for an adaptive codebook 102 excitation vector and stochastic codebook 103 excitation vector by means of an open-loop procedure. This open-loop search procedure is described below.

(1) First, excitation vector creation section 104 chooses excitation vector candidates (adaptive excitation vectors) in succession from adaptive codebook 102 only, LPC combining section 105 creates a composite tone, and comparison section 106 carries out a comparison of the input speech and composite tone and selects the optimum adaptive codebook 102 code. At this time, gain is selected on the assumption that it is the value at which coding distortion is minimal (optimum gain).

(2) Next, the above-described adaptive codebook code is fixed, excitation vector creation section 104 successively selects the same excitation vector from adaptive codebook 102 and stochastic codebook 103 successively selects the excitation vector (stochastic excitation vector) corresponding to the comparison section 106 code, LPC combining section 105 generates composite tones, and comparison section 106 compares the sum of both composite tones with the input speech and determines the optimum stochastic codebook 103 code. As in (1) above, gain is selected at this time on the assumption that it is the value at which coding distortion is minimal (optimum gain).

Use of the above procedure to search for the optimum excitation vector results in a slight degradation of coding capability, but also a major reduction in the amount of calculation, compared with the method of searching for the optimum excitation vector by comparing combinations of all excitation vectors or both codebooks.

The stochastic codebook 103 excitation vector search method will now be described in detail.

Excitation vector code derivation is carried out by searching for the excitation vector that minimizes coding distortion E in Equation (1) below. In Equation (1), x denotes the coding target; p, adaptive excitation vector gain; H, a weighting combining filter; a, an adaptive excitation vector; q, stochastic excitation vector gain; and s, a stochastic excitation vector.

$$E=|x-(pHa+qHs)|^2 \qquad \text{Equation (1)}$$

As the adaptive excitation vector search is performed by means of an open-loop procedure, stochastic codebook 103 code derivation is performed by searching for the excitation vector that minimizes coding distortion E in Equations (2) below. In Equations (2), y denotes the stochastic excitation vector search target vector.

$$y=x-pHa$$

$$E|y-qHs|^2 \qquad \text{Equations (2)}$$

Here, gain values p and q are determined after the excitation vector search, and by making gain p=gain q=1, Equations (2) above can be written as Equations (3) below.

$$y = x - \frac{x \cdot Ha}{|Ha|^2} Ha \qquad \text{Equations (3)}$$

$$E = \left|y - \frac{y \cdot Hs}{|Hs|^2} Hs\right|^2$$

Minimizing this distortion expression is equivalent to maximizing function C in Equation (4) below.

$$C = \frac{(yH \cdot s)^2}{sHHs} \qquad \text{Equation (4)}$$

Therefore, in the case of a search for an excitation vector composed of a small number of pulses such as an algebraic codebook excitation vector, calculating yH and HH beforehand enables function C above to be found with a small amount of calculation.

yH can be found by reversing the order of vector y and convoluting matrix H, and then reversing the order of the result, and HH can be found by multiplication of the matrices.

Stochastic codebook 103 searches for and codes a stochastic excitation vector using the procedure described in (1) through (4) below.

(1) First, as preliminary processing, vector yH and matrix HH are found.

(2) Next, pulse polarities are determined from the polarities (+ −) of vector yH elements. Specifically, the polarity of the pulse at each position is matched to the value of that position in yH, and the polarity of the yH value is stored in another array. After the polarities of all positions have been stored in another array, yH values are all made absolute values and converted to positive values. HH values are also converted in accordance with these polarities by performing polarity multiplication.

(3) Next, function C shown in Equation (4) is found by adding yH and HH values using an n-fold loop (where n is the number of channels), and the pulse positions of the channels at which this value is largest are found.

(4) The found pulse position of each channel is coded, and a code combining this with a polarity code is taken as the stochastic excitation vector code.

With reference now to the accompanying drawings, stochastic codebook excitation vector coding methods according to embodiments of the present invention will be explained in detail below. In the descriptions of these embodiments, an algebraic codebook is used for which the subframe length is 32 and the number of pulses (=number of channels) is 4.

Embodiment 1

In Embodiment 1, a case is described in which an index of a predetermined channel is changed in accordance with another channel.

In this embodiment, channel 0 pulse positions ici0[i0], channel 1 pulse positions ici1[j1], channel 2 pulse positions ici2[j2], and channel 3 pulse positions ici3[j3] are as shown below.

ici0[i0]={0, 4, 8, 12, 16, 20, 24, 28} ici1[j1]={1, 5, 9, 13, 17, 21, 25, 29} ici2[j2]={2, 6, 10, 14, 18, 22, 26, 30} ici3[j3]={3, 7, 11, 15, 19, 23, 27, 31}

Here, i0 (0≦i0≦7) is the index of channel 0, j1 (0≦j1≦7) is the index of channel 1, j2 (0≦j2≦7) is the index of channel 2, and j3 (0≦j3≦7) is the index of channel 3.

For example, the i0=0 pulse position is {0}, the i0=1 pulse position is {4}, and so on; and the j1=0 pulse position is {1}, the j1=1 pulse position is {5}, and so on.

Channel 1, channel 2, and channel 3 pulses are grouped into pairs. For example, for channel 1, pulses are grouped into group 0 {1, 5}, group 1 {9, 13}, group 2 {17, 21}, and group 3 {25, 29}.

Then, if i1 (0≦i1≦3) is designated the channel 1 group index, i2 (0≦i2≦3) is designated the channel 2 group index, and i3 (0≦i3≦3) is designated the channel 3 group index, the relationship between indexes j1, j2, and j3 and group indexes i1, i2, and i3 is as shown in Equations (5) below.

$$j1=i1\times 2+(i0\%\ 2)$$

$$j2=i2\times 2+((i0+i1)\%2)$$

$$j3=i3\times 2+((i1+i2)\%2) \qquad \text{Equation (5)}$$

In Equations (5), the "%" symbol denotes an operation that finds the remainder when the numeric value on the left of "%" (index) is divided by the numeric value on the right. If indexes i0 through i3 are expressed as binary numbers, the "%" operation can be implemented simply by checking the code of the least significant bit of the index on the left.

In this embodiment, as shown in Equations (5) above, the indexes of channels 1 through 3 are changed according to the index of another channel. For example, index j1 of channel 1 changes according to index i0 of channel 0, so that ici1[j1]={1, 9, 17, 25,} when i0=0, and ici1[j1]={5, 13, 21, 29} when i0=1.

Figure 2:
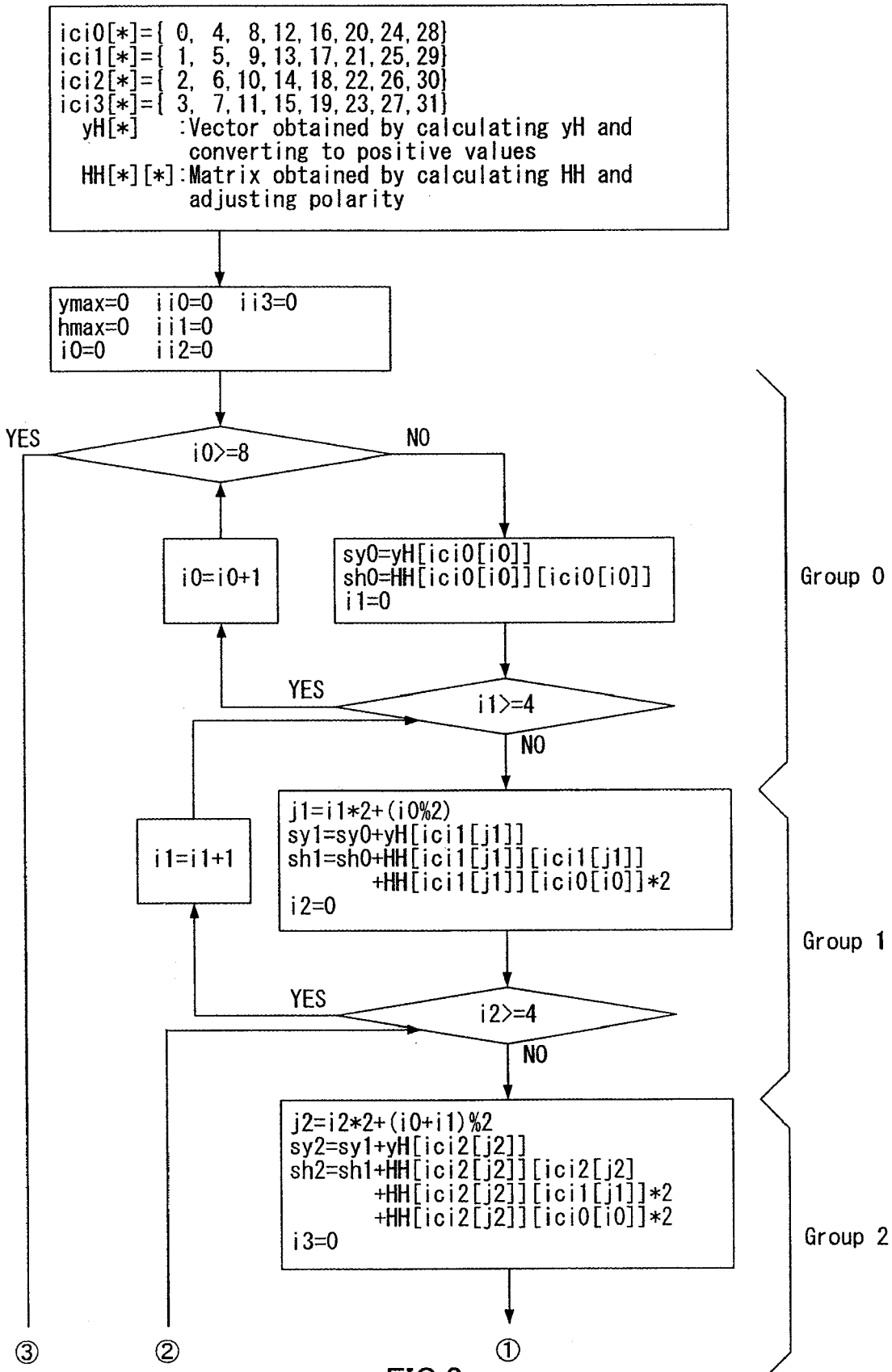
FIG. 2 is a flowchart showing an example of a pulse search algorithm for each channel in a coding method according to Embodiment 1 of the present invention.
Figure 3:
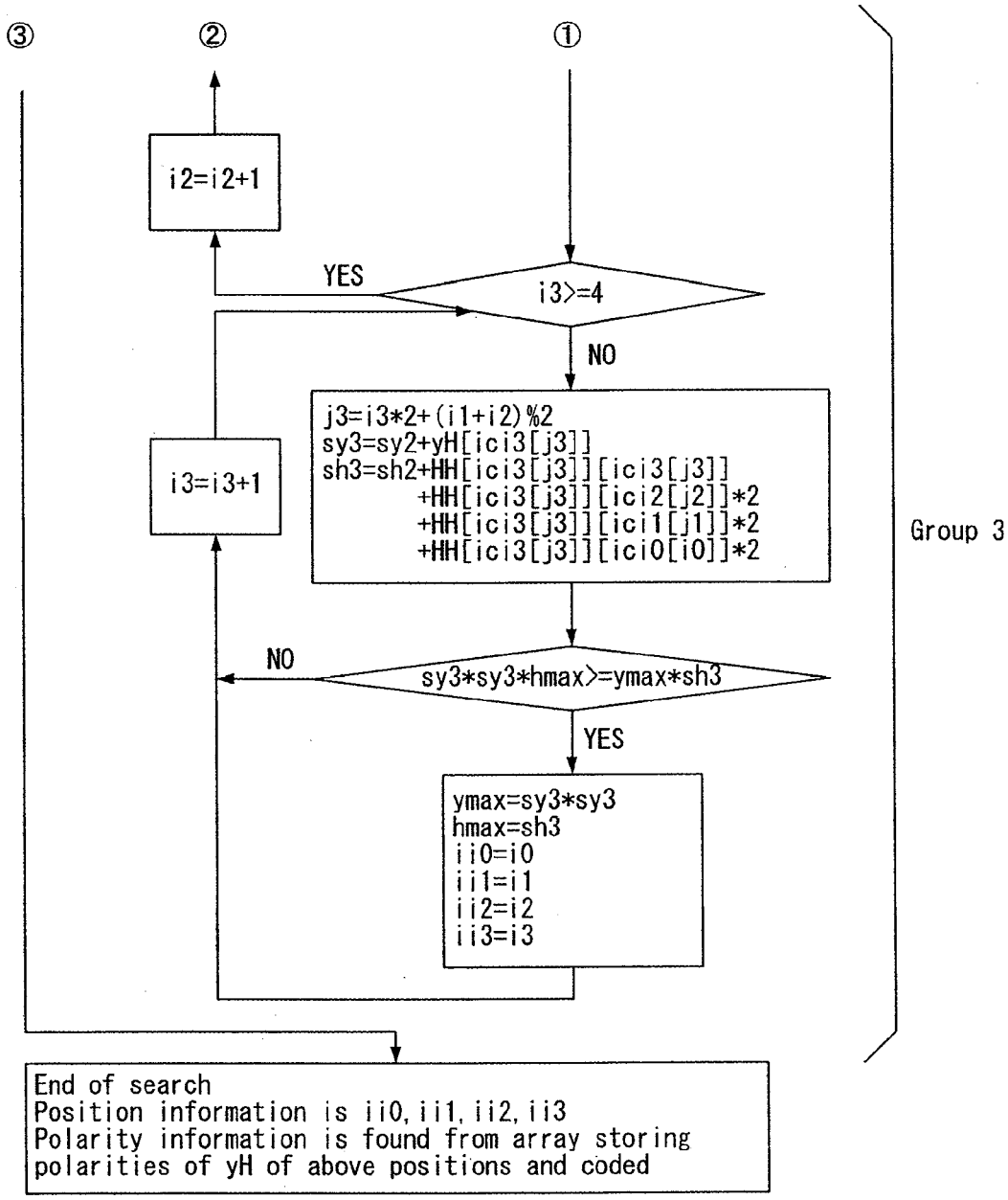
FIG. 3 is a flowchart showing an example of a pulse search algorithm for each channel in a coding method according to Embodiment 1 of the present invention.

FIG. 2 and FIG. 3 are flowcharts showing an example of a pulse search algorithm for each channel in a coding method according to this embodiment.

In FIG. 2 and FIG. 3, loop 0 is a loop in which i0 is changed from 0 through 7, loop 1 is a loop in which i1 is changed from 0 through 3, loop 2 is a loop in which i2 is changed from 0 through 3, and loop 3 is a loop in which i3 is changed from 0 through 3.

In FIG. 2 and FIG. 3, first, i0, i1, and i2 are fixed at 0, and as the first stage, y and H in each i3 are calculated in loop 3, and maximum values ymax and Hmax thereamong, and i0, i1, i2, and i3 at that time are stored as ii0, ii1, ii2, and ii3 respectively. In this case, the channel pulse positions searched for are ici3[j3]={3, 11, 19, 27}.

Next, as the second stage, i2 is incremented in loop 2, and the above first-stage computations are performed for each i2. When i0=0, i1=0, and i2=1, the channel 3 pulse positions searched for in the first stage are ici3[j3]={7, 15, 23, 31}. Thus, the channel 3 pulse positions searched for in the first stage change according to the values of i0, i1, and i2.

Then, as the third stage, i1 is incremented in loop 1, and the above first-stage and second-stage computations are performed for each i1. In this case, the channel 2 pulse positions searched for in the second stage change according to the values of i0 and i1.

Lastly, as the fourth stage, i0 is incremented in loop 0, and the above first-stage, second-stage, and third-stage computations are performed for each i0. In this case, the channel 1 pulse positions searched for in the third stage change according to the value of i0.

Thus, in this embodiment, using an n-fold loop search algorithm (where n is the number of channels), internal loop candidate positions are changed according to loop-external codes.

Then ii0, ii1, ii2, and ii3 are found for which y and H are largest at all pulse positions searched for.

As a result, ii0 is 3 bits and ii1, ii2, and ii3 are 2 bits each, so that pulse position coding can be performed in 9 bits, and together with the polarity codes of each channel (1 bit×4 channels), coding can be performed with a 13-bit code. Therefore, compared with the conventional method, the number of bits necessary for coding can be reduced, and a lower bit rate can be achieved.

Meanwhile, 8 locations are possible respectively for indexes j1, j2, and j3 of channels 1 through 3, and therefore there are no positions where there is no pulse at all in a subframe, variations of excitation vector waveforms corresponding to codes (position information) can be secured, and sound quality degradation can be prevented.

Thus, according to this embodiment, pulse positions of a predetermined channel are associated with pulse positions of another channel by changing the predetermined channel index in accordance with another channel. As a result, a stochastic excitation vector can be represented by fewer bits than heretofore, and variations can be secured so that there are no positions where there is no pulse at all.

Embodiment 2

In Embodiment 2, a case is described in which the pulse positions themselves of a predetermined channel are changed in accordance with another channel.

In this embodiment, channel 0 pulse positions ici0[i0], channel 1 pulse positions ici1[i1], channel 2 pulse positions ici2[i2], and channel 3 pulse positions ici3[i3] are as shown below.

ici0[i0]={4, 7, 12, 15, 20, 23, 28, 31} ici1[i1]={0, 8, 16, 24} ici2[i2]={2, 10, 18, 26} ici3[i3]={5, 13, 21, 29}

Here, i0 ($0 \leqq i0 \leqq 7$) is the index of channel 0, i1 ($0 \leqq i1 \leqq 7$) is the index of channel 1, i2 ($0 \leqq i2 \leqq 3$) is the index of channel 2, and i3 ($0 \leqq i3 \leqq 3$) is the index of channel 3.

For example, the i0=0 pulse position is {4}, the i0=1 pulse position is {7}, and so on; and the i1=0 pulse position is {0}, the i1=1 pulse position is {8}, and so on.

Then channel pulse positions ici0[i0], ici1[i1], ici2[i2], and ici3[i3] are adjusted to k0, k1, k2, and k3 with indexes i0, i1, i2, and i3 by means of Equations (6) below.

$$k0 = ici0[i0] \qquad \text{Equation (6)}$$

$$k1 = ici1[i1] \times 2 + (i0 \ \% \ 2)$$

$$k2 = ici0[i2] \times 2 + ((i0 + i1) \ \% \ 2)$$

$$k3 = ici0[i3] \times 2 + ((i1 + i2) \ \% \ 2)$$

In Equations (6), the "%" symbol denotes an operation that finds the remainder when the numeric value on the left of "%" (index) is divided by the numeric value on the right.

In this embodiment, as shown in Equations (6) above, the pulse positions themselves of channels 1 through 3 are changed according to another channel. As a result, adjusted pulse positions k0, k1, k2, and k3 of channels 0 through 3 are as shown below.

k0={4, 7, 12, 15, 20, 23, 28, 31}
k1={0, 1, 8, 9, 16, 17, 24, 25}
k2={2, 3, 10, 11, 18, 19, 26, 27}
k3={5, 6, 13, 14, 21, 22, 29, 30}

Figure 4:
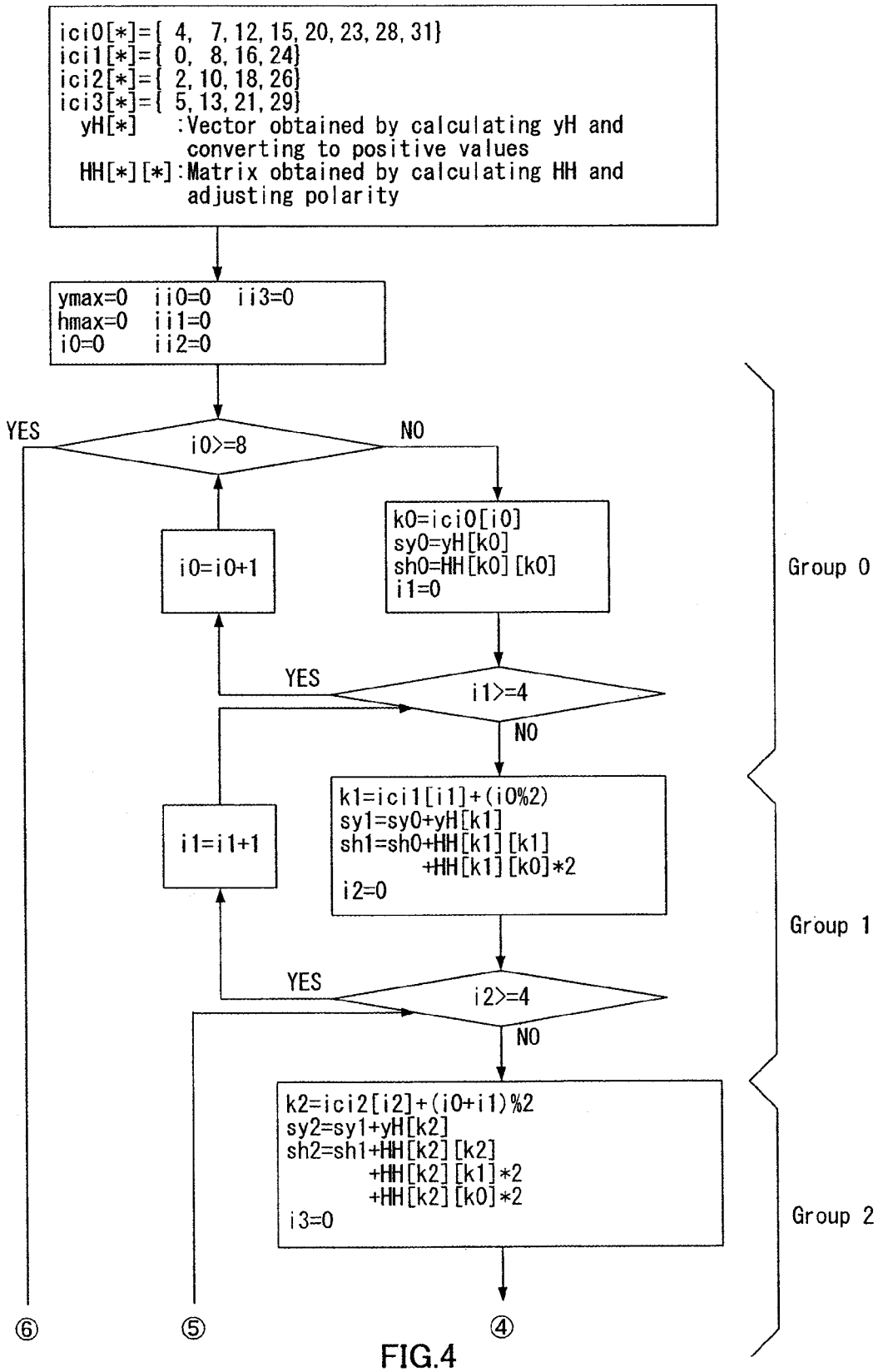
FIG. 4 is a flowchart showing an example of a pulse search algorithm for each channel in a coding method according to Embodiment 2 of the present invention.
Figure 5:
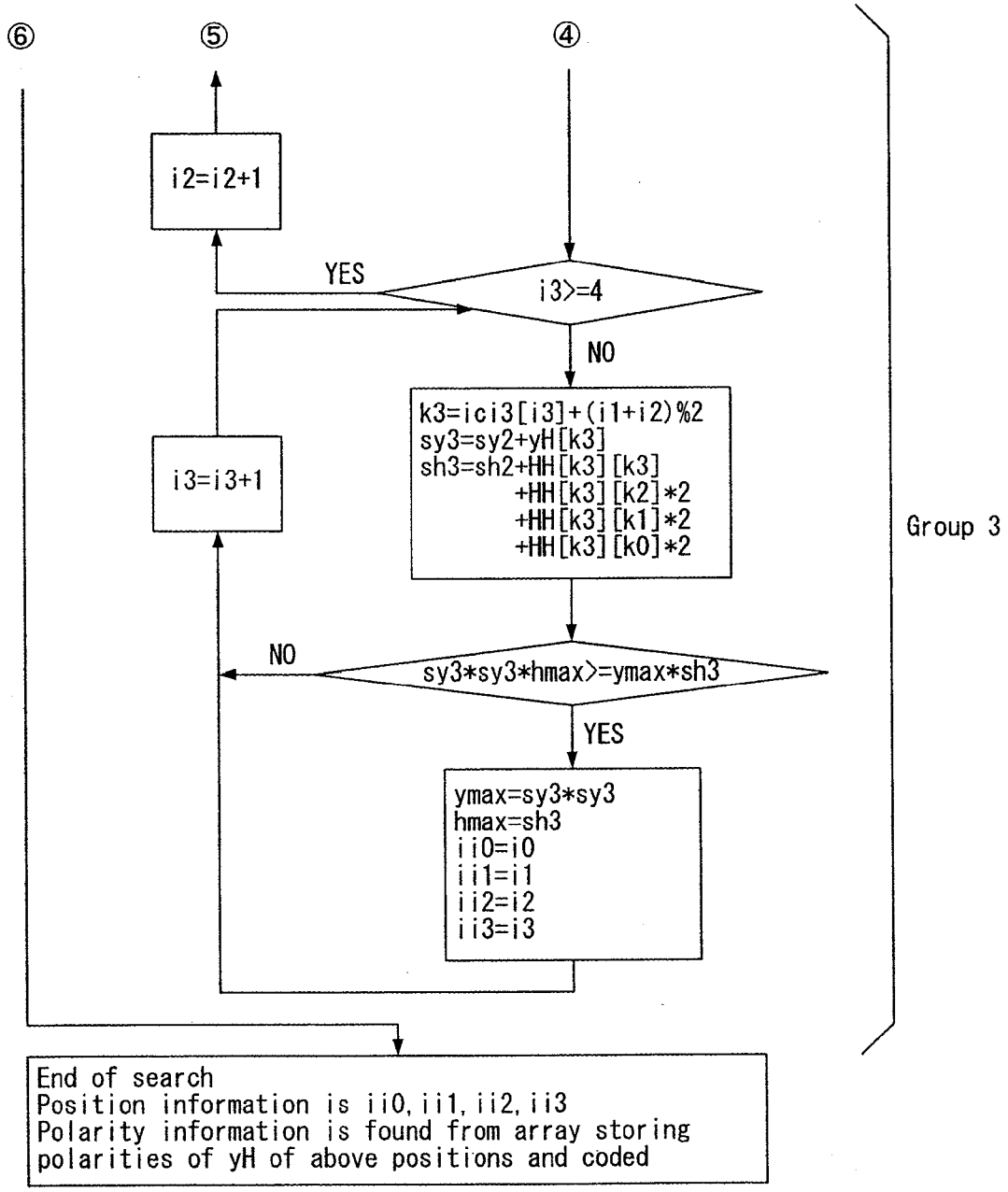
FIG. 5 is a flowchart showing an example of a pulse search algorithm for each channel in a coding method according to Embodiment 2 of the present invention.

FIG. 4 and FIG. 5 are flowcharts showing an example of a pulse search algorithm for each channel in a coding method according to this embodiment.

In FIG. 4 and FIG. 5, loop 0 is a loop in which i0 is changed from 0 through 7, loop 1 is a loop in which i1 is changed from 0 through 3, loop 2 is a loop in which i2 is changed from 0 through 3, and loop 3 is a loop in which i3 is changed from 0 through 3.

In FIG. 4 and FIG. 5, first, i0, i1, and i2 are fixed at 0, and as the first stage, y and H in each i3 are calculated in loop 3, and maximum values ymax and Hmax thereamong, and i0, i1, i2, and i3 at that time are stored as ii0, ii1, ii2, and ii3 respectively.

Next, as the second stage, i2 is incremented in loop 2, and the above first-stage computations are performed for each i2.

Then, as the third stage, i1 is increased in loop 1, and the above first-stage and second-stage computations are performed for each i1.

Lastly, as the fourth stage, i0 is increased in loop 0, the above first-stage, second-stage, and third-stage computations are performed for each i0, and ii0, ii1, ii2, and ii3 are found for which y and H are largest at all pulse positions searched for.

As a result, ii0 is 3 bits and ii1, ii2, and ii3 are 2 bits each, so that pulse position coding can be performed in 9 bits, and together with the polarity codes of each channel (1 bit×4 channels), coding can be performed with a 13-bit code. Therefore, compared with the conventional method, the number of bits necessary for coding can be reduced, and a lower bit rate can be achieved.

Meanwhile, 8 locations are possible respectively for the adjusted pulse positions (k1, k2, and k3) of channels 1 through 3, and therefore there are no positions where there is no pulse at all in a subframe, variations of excitation vector waveforms corresponding to codes (position information) can be secured, and sound quality degradation can be prevented.

Thus, according to this embodiment, by changing the pulse positions of a predetermined channel in accordance with another channel, a stochastic excitation vector can be represented by fewer bits than heretofore, and variations can be secured so that there are no positions where there is no pulse at all.

In a stochastic codebook provided in a speech decoding apparatus, a stochastic excitation vector searched for by a speech coding apparatus can be found by performing computations by means of an above-described search algorithm on codes of each channel coded and transmitted in an above-described embodiment.

In the above embodiments, a 2's remainder is found as variations are assumed to be 2-fold, but the present invention is not limited to this, and is also effective in a case where the numeric value for which a remainder is found is made larger, to 3 or more, in order to achieve a still lower bit rate and extended subframe length.

Also, in the above embodiments, information of a plurality of channels is integrated by means of addition, but the present invention is not limited to this, and is also effective in a case where a more sophisticated function, such as weighted addition (addition with multiplication by a constant) or a random number generator, is used.

Furthermore, in the above embodiments, a value reflecting information of another channel is extracted by means of multiplication, but the present invention is not limited to this, and is also effective in a case where a more sophisticated function is used, such as when a random number generator or conversion table is used.

Moreover, in the above embodiments, a case has been described in which an algebraic codebook is used and an impulse position corresponds to a code, but the present invention is not limited to this, and is also effective in a case where a stochastic codebook is composed of sums of partial waveforms, and the starting position thereof corresponds to a code.

Also, in the above embodiments, a case has been described in which an algebraic codebook is used and an impulse position corresponds to a code, but the present invention is not limited to this, and is also effective in a case where a stochastic codebook is composed of a multiplicity of fixed waveforms stored in ROM, and an excitation vector waveform is created by the sum of a plurality thereof, and that waveform number corresponds to a code. In this case, the present invention can be applied easily by replacing "position" with "waveform number."

As is clear from the above description, according to the present invention, by performing coding with a pulse position of a predetermined channel associated with a pulse position of another channel, and taking a code combining this and a polarity code as a stochastic codebook excitation vector code, it is possible to represent a stochastic excitation vector with fewer bits than heretofore, and to secure variations so that there are no positions where there is no pulse at all.

This application is based on Japanese Patent Application No. 2002-330768 filed on Nov. 14, 2002, the entire content of which is expressly incorporated by reference herein.

INDUSTRIAL APPLICABILITY

The present invention is applicable to a CELP speech coding apparatus/speech decoding apparatus.

The invention claimed is:

1. A coding method of an excitation vector of a stochastic codebook used in a speech coding apparatus that is divided into a plurality of channels, the coding method comprising:

associating an excitation vector waveform candidate of a predetermined channel with an excitation vector waveform candidate of another channel, such that the excitation vector waveform candidate of the predetermined channel changes in association with a change of a number representing the excitation vector waveform candidate of the another channel;

searching for an excitation vector waveform that minimizes coding distortion using the associated excitation vector waveform candidate of the predetermined channel and the excitation vector waveform candidate of the another channel; and determining a code of the excitation vector of the stochastic codebook using a code of the excitation vector waveform obtained by the searching, wherein:

the searching, after the associating, calculates a function value using the number representing the changed excitation vector waveform candidate of the another channel and the excitation vector waveform candidate of the predetermined channel changed based on the associating, and, by the function value, finds an excitation vector waveform candidate of each channel that minimizes the coding distortion; and the determining finds the code of the excitation vector waveform by coding the excitation vector waveform candidate of each channel that minimizes the coding distortion as the excitation vector waveform, and determines the code of the excitation vector of the stochastic codebook using the code of the excitation vector waveform.

2. The coding method of claim 1, wherein:

the searching searches for the excitation vector waveform by a loop calculation of n-fold loops, multiplexed a number of times corresponding to a number of channels n, and repeats the associating predetermined times to change the excitation vector waveform candidate of the predetermined channel by changing the number representing the excitation vector waveform candidate of the another channel, and the loop calculation changes the number representing the excitation vector waveform candidate of the another channel by a predetermined loop, changing the excitation vector waveform of the predetermined channel by a loop within the predetermined loop.

3. The coding method of claim 1, wherein the stochastic codebook comprises an algebraic codebook, and the excitation vector waveform candidate is represented by a pulse position.

4. The coding method of claim 1, wherein the associating associates the excitation vector waveform candidate of the predetermined channel with a remainder operation result using the number representing the excitation vector waveform candidate of the another channel.

* * * * *